US005366853A

United States Patent [19]

Yoshimoto

[11] Patent Number: 5,366,853

[45] Date of Patent: Nov. 22, 1994

[54] TABLET-SHAPED PROCESSING AGENT AND METHOD FOR PROCESSING SILVER HALIDE PHOTOGRAPHIC LIGHT SENSITIVE MATERIALS

[75] Inventor: Hiroshi Yoshimoto, Hino, Japan

[73] Assignee: Konica Corporation, Tokyo, Japan

[21] Appl. No.: 150,273

[22] Filed: Nov. 9, 1993

Related U.S. Application Data

[63] Continuation of Ser. No. 965,881, Oct. 23, 1992, abandoned.

[30] Foreign Application Priority Data

Nov. 6, 1991 [JP] Japan ..... 3-288992

[51] Int. Cl.[5] ..... G03C 5/38; G03C 7/00; G03C 5/44; G03C 5/18

[52] U.S. Cl. ..... 430/400; 430/393; 430/430; 430/450; 430/458; 430/461

[58] Field of Search ..... 424/464; 430/30, 400, 430/430, 450, 458, 461, 465, 393, 451, 429

[56] References Cited

U.S. PATENT DOCUMENTS

| | | | |
|---|---|---|---|
| 2,482,546 | 9/1949 | Kaszuba | 95/88 |
| 2,596,926 | 12/1949 | Gunther et al. | 95/2 |
| 2,610,122 | 9/1952 | John et al. | 95/88 |
| 2,843,484 | 7/1958 | Baxendale | 96/66 |
| 3,128,182 | 4/1964 | Bard et al. | 96/61 |
| 3,128,183 | 4/1964 | Jones et al. | 96/107 |
| 3,158,482 | 11/1964 | Lucas | 430/465 |
| 3,253,919 | 5/1966 | Beavers et al. | 96/50 |
| 3,260,718 | 7/1966 | Johnson | 260/247.1 |
| 3,287,124 | 11/1966 | Green et al. | 96/29 |
| 3,287,125 | 11/1966 | Green et al. | 96/29 |
| 3,335,161 | 8/1967 | Fields et al. | 260/455 |

(List continued on next page.)

FOREIGN PATENT DOCUMENTS 831928 1/1970 Canada .

(List continued on next page.)

*Primary Examiner*—Charles L. Bowers, Jr.
*Assistant Examiner*—J. Pasterczyk
*Attorney, Agent, or Firm*—Frishauf, Holtz, Goodman & Woodward

[57] ABSTRACT

A tablet-shaped bleaching agent for preparing a bleaching solution for color silver halide photographic materials is disclosed, along with the method of making it, the method of using it to prepare a bleaching solution, and the method of processing a color silver halide photographic material using a replenishing solution made from the tablet as a bleaching solution. The tablet has a bulk density of 1.00 to 3.00 g/cm$^3$, and a total ammonium content of no more that 50 mol % of the total cation content in the tablet. The tablet comprises a ferric complex salt of a compound represented by Formula (L) and an organic polyacid according to Formula (C). In Formula (L), $A_{1-4}$ each represent —$CH_2OH$, —COOM, or —$PO_3M_1M_2$, and X represents a substituted or unsubstituted alkylene group of 3-6 carbon atoms. In Formula (C), $A_5$ represents an organic group, and n is an integer of not less than 2.

Formula (L)

Formula (C)

$A_5$—$(COOM)_n$

8 Claims, 2 Drawing Sheets

U.S. PATENT DOCUMENTS

| | | | |
|---|---|---|---|
| 3,532,501 | 10/1970 | Mackey et al. | 96/107 |
| 3,582,346 | 6/1971 | Dersch | 96/109 |
| 3,813,247 | 5/1974 | Minsk et al. | 96/68 |
| 4,119,462 | 10/1978 | Hodes | 96/66.3 |
| 4,230,796 | 10/1980 | Gunther et al. | 430/523 |
| 4,601,975 | 7/1986 | Koboshi et al. | 430/430 |
| 4,814,177 | 3/1989 | Walsdorf et al. | 424/464 |
| 5,063,140 | 11/1991 | Kuse et al. | 430/430 |
| 5,279,930 | 1/1994 | Green et al. | 430/400 |

FOREIGN PATENT DOCUMENTS

| | | | |
|---|---|---|---|
| 0358034 | 9/1988 | European Pat. Off. . | |
| 0358035 | 9/1988 | European Pat. Off. . | |
| 0405238 | 6/1989 | European Pat. Off. . | |
| 0450293 | 10/1991 | European Pat. Off. . | |
| 2286415 | 4/1976 | France . | |
| 2541519 | 9/1979 | Germany . | |
| 4120867 | 1/1993 | Germany | 430/399 |
| 51-61837 | 5/1976 | Japan . | |
| 52-88025 | 7/1977 | Japan . | |
| 53-28426 | 3/1978 | Japan . | |
| 53-95630 | 8/1978 | Japan . | |
| 54-155038 | 12/1979 | Japan . | |
| 62-123459 | 6/1987 | Japan . | |
| 63-17445 | 1/1988 | Japan . | |
| 1-295258 | 11/1989 | Japan . | |
| 2-109042 | 4/1990 | Japan . | |
| 2-109043 | 4/1990 | Japan . | |
| 3-39735 | 2/1991 | Japan . | |
| 3188443 | 8/1991 | Japan | 430/430 |
| 27589 | of 1912 | United Kingdom | 430/465 |
| 1213808 | 11/1970 | United Kingdom . | |

TABLET-SHAPED PROCESSING AGENT AND METHOD FOR PROCESSING SILVER HALIDE PHOTOGRAPHIC LIGHT SENSITIVE MATERIALS

This application is a continuation, of application Ser. No. 07/965,881, filed Oct. 23, 1992 (abandoned).

FIELD OF THE INVENTION

This invention relates to processing agents for silver halide photographic light sensitive materials (i.e., photographic processing agents) and, particularly, to tablet-shaped photographic processing agents, which are capable of preventing the fine powder of the photographic processing agents from being scattered and distributing the working and social environment without making use of any plastic-made bottle, and to a method for processing the silver halide photographic light sensitive materials with the above-mentioned photographic processing agents.

BACKGROUND OF THE INVENTION

Processing solutions for developing silver halide photographic light sensitive materials, such as a black-and-white developer, a fixer, a color developer, a bleacher, a bleach-fixer and a stabilizer, are often packaged in plastic containers as concentrated solutions for ease of handling. The containers can be supplied together to the end user, as a processing agent kit. The concentrated solutions are dissolved in water by the user, to prepare the working solutions.

Recently in the photographic processing industry, many small-sized photofinishing laboratories, so-called Mini-Labs, have been established in which small-sized automatic processors are being used. With the spread of the mini-labs, the plastic bottles for processing agents have also rapidly increased in numbers year by year.

The plastics have been widely used for not only the bottles for photographic processing agents but also many other purposes, because they are light in weight and durable in nature. The output of plastic material in the whole world kept increasing year by year, and the annual output in 1988 exceeded one billion tons. On the other hand, the amount of discarded plastic has increased tremendously. In Japan, for example, about 40% of the total output thereof is wasted yearly. When the plastic wastes are abandoned in the sea, the inhabitable conditions for oceanic life deteriorate. In Europe, acid rain problems have also been raised, because the plastics are incinerated in trash burners having imperfect exhaust-gas treatment units. The above-mentioned problems have been becoming serious.

Therefore, some urgent countermeasures must be taken to solve the problems. In Europe, there are, at present, the positive movements to enact legal regulations on, for example, an obligation to recycle plastics or not to use plastics but to use decomposable plastics.

In view of the consideration described above, it is objectionable to use even a small number of plastic bottles for shipment of photographic processing solutions.

One possible way to avoid the use of plastic bottles to ship concentrated photographic processing liquids, is to ship them as powders. When dissolving the powders, some of the fine particles can become suspended in air, creating a health hazard for workers who may inhale the particles and/or possibly contaminate other processing solution baths when the particles settle. Accordingly, the technique for granulating a photographic processing agent so as to make a granulated mixture have been proposed in, for example, Japanese Patent Publication Open to Public Inspection (hereinafter referred to as JP OPI Publication) Nos. 2-109042/1990 and 2-109043/1990, U.S. Pat. No. 2,843,484 and JP OPI Publication No. 3-39735/1991. However, there are still problems raised, such as the labor safety and hygienic problems produced by scattering the powdery dust discussed above. In addition, there are problems of caking and/or incomplete dissolution due to properties of the granules. It is, therefore, the actual situation that an agent suitable for powdering or granulating is still considerably limited.

As for the desirable forms of the processing agents capable of effectively employing the advantages which the above-mentioned dried agents have, the tableted agents are proposed in, for example, JP OPI Publication No. 51-61837/1976 and Canadian Patent No. 831,928. However, other new problems are raised when making tableted agents. The problems are as follows. Stains are produced when development is carried out utilizing a processing solution prepared from a stored tablet and, further, yellow stain is produced in the edge portions of a processed color paper. The above-mentioned two points are the important keys for the photographic characteristics and, if these problems are produced, the commercial values of the agents are so greatly decreased as to raise a serious problem. The resolution of the problems has now become urgent.

SUMMARY OF THE INVENTION

After the present inventors have seriously studied, they discovered that the above-described problems relate to the ratios of the ammonium cation content of a tablet-shaped processing agent to the total cation content thereof and they have achieved the invention.

As the other advantages, the abrasion degrees and solubility of a tablet-shaped agent can be improved and the working environmental is also improved without scattering any fine powder. The advantages are so amazing that no anticipation could be made at all from any knowledge so far.

It is accordingly an object of the invention to provide 9 processing agent for silver halide photographic light sensitive materials and a method of processing silver halide photographic light sensitive materials, in which the following special features can be provided.

(1) Amounts of the packaging materials (including, particularly, plastic bottles) used therein can be reduced and a social environmental aptitude can also be provided;

(2) Processing agents can be made light in weight by tableting them; the transportation cost can be reduced; and storage space of the agents can be saved in every photofinishing laboratory;

(3) Storage stability can be improved; and any stain production in making every development and any contamination on light sensitive materials after completing every processing treatment can be eliminated;

(4) Each fine powder of every photographic processing agent cannot be scattered; and the working environmental aptitude can also be provided;

(5) Any contamination can be prevented; and (6) The solubility of each tablet-shaped photographic processing agent can be improved; and the abrasion degree of each tablet can also be reduced.

The above-mentioned objects of the invention can be achieved with a tablet-shaped processing agent for silver halide photographic light sensitive materials, which contains at least one kind of the ferric complex salts of organic acid; wherein the ratio of the ammonium cation content of the tablet to the total cation content thereof is to be not higher than 50 mol %.

Further, (a) in the above-mentioned tablet-shaped processing agents for silver halide photographic light sensitive materials, the ratio of the ammonium cation content to the total cation content is not higher than 20 mol %;

(b) the above-mentioned tablet-shaped processing agent for silver halide photographic light sensitive materials is a bleacher;

(c) an organic acid contained in the above-mentioned tablet-shaped processing agent for silver halide photographic light sensitive materials is a compound represented by the following Formula (L),

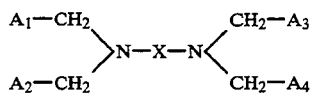

Formula (L)

wherein $A_1$, $A_2$, $A_3$ and $A_4$ may be the same with or the different from each other and represent each $—CH_2OH$, —COOM or $—PO_3M_1M_2$.

M, $M_1$ and $M_2$ represent each a hydrogen atom, an alkali-metal atom or an ammonium group; and X represents an alkylene group having 3 to 6 carbon atoms;

(d) the above-described tablet-shaped processing agent for silver halide photographic light sensitive materials is one prepared by granulating the agent and then by tableting it; and (e) it is a preferable embodiment of the invention that silver halide photographic light sensitive materials are processed with the tablet-shaped processing agent specified in the above-mentioned paragraphs (a), (b), (c) and (d), because the advantages of the invention can be displayed thereby.

The above-mentioned cation forms a cation in a solution in which the tablet-shaped processing agent of the invention is dissolved.

wherein

Figure 1:
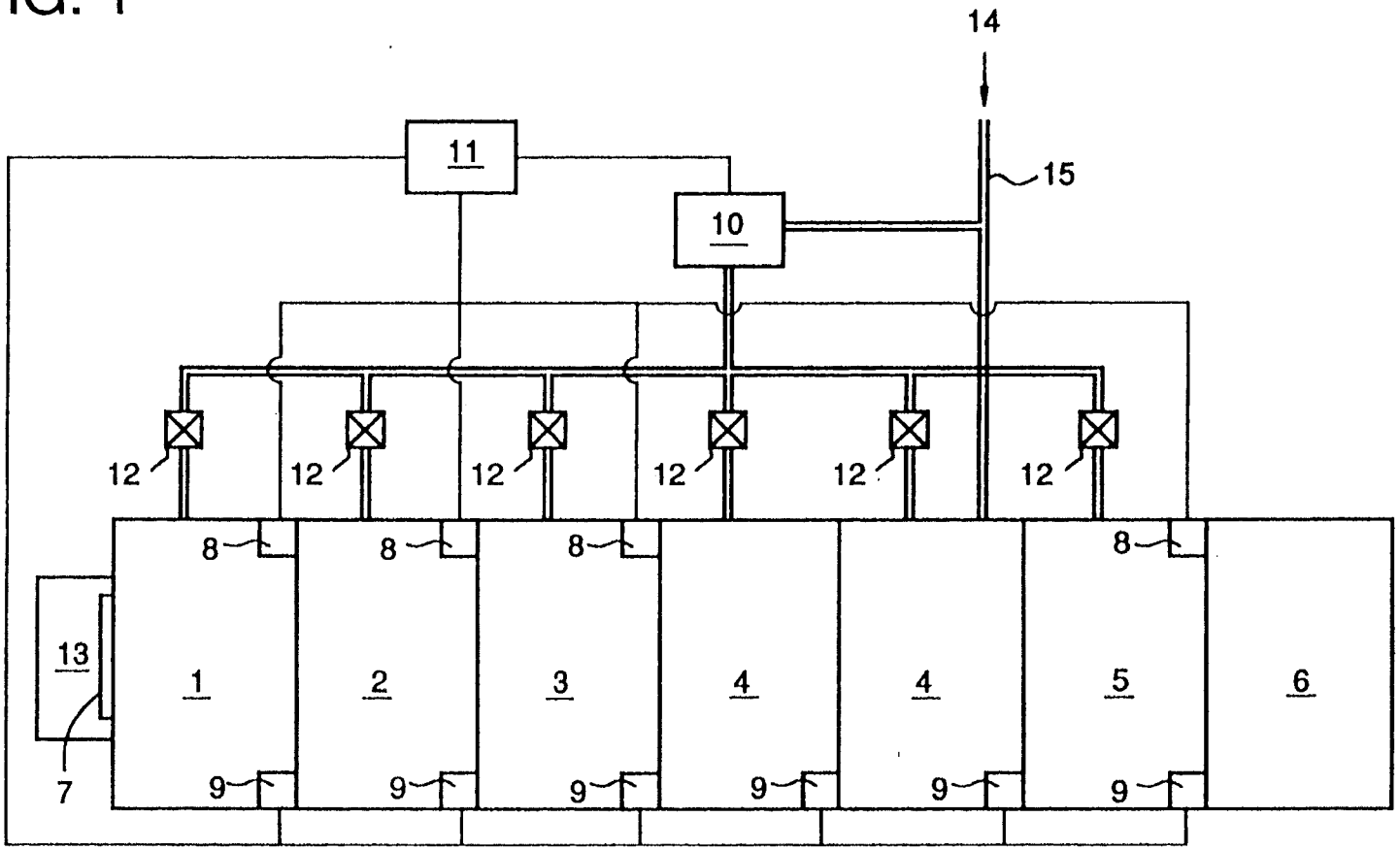
FIG. 1 is a schematic illustration showing an example of the automatic processors relating to the invention.

1 color developing tank;
2 bleaching tank;
3 fixing tank;
4 washing tank;
5 stabilizing tank;
6 drying section;
7 light sensitive material area detection sensor;
8 tablet-shaped processing agent supply unit;
9 liquid surface detection sensor;
10 water replenisher unit;
11 control section;
12 electromagnetic valve;
13 light sensitive material insertion section;
14 warm washing water;
15 water replenishing pipe;
16 main processing tank;
17 processing solution;
18 circulation pump;
19 thermostat heater;
20 sub-tank;
20A guide plate;
20B Top cover;
21 filter unit;
24 tablet-shaped processing agent;
24A uppermost tablet-shaped processing agent;
27 communicating pipe;
28 processing rack;
29 overflow outlet;
39 filter;
91 supply tray body;
92 piston slide table;
94, 99 each a plunger;
94A, 99A each a rack;
95, 97 each a stepping motor;
96, 98 each a pinion

DETAILED DESCRIPTION OF THE INVENTION

Now, the invention will be detailed below.

The ferric complex salts of the organic acids, which are applicable to the tablet-shaped processing agents of the invention and represented by Formula [L], will now be detailed.

In Formula (L), $A_1$ through $A_4$ may be the same with or the different from each other and represent each $—CH_2OH$, —COOM or $—PO_3M_1M_2$ in which M, $M_1$ and $M_2$ represent each a hydrogen atom, an alkali-metal atom (such as that of sodium or potassium) or an ammonium group; and X represents a substituted or unsubstituted alkylene group having 3 to 6 carbon atoms (such as a propylene, butylene or pentamethylene group). The substituents include, for example, an alkyl group having 1 to 3 carbon atoms.

The typical examples of the desirable compounds represented by the foregoing Formula (L) will be given below.

(L-1) 1,3-propanediamine tetraacetic acid,
(L-2) 2-hydroxy-1,3-propanediamine tetraacetic acid,
(L-3) 2,3-propanediamine tetraacetic acid,
(L-4) 1,4-butanediamine tetraacetic acid,
(L-5) 2-methyl-1,3-propanediamine tetraacetic acid,
(L-6) N-(2-hydroxyethyl)-1,3-propanediamine tetraacetic acid,
(L-7) 1,3-propanediamine tetrakismethylene phosphonic acid,
(L-8) 2-hydroxy-1,3-propanediamine tetrakismethylene phosphonic acid,
(L-9) 2,2-dimethyl-1,3-propanediamine tetraacetic acid,
(L-10) 2,4-butanediamine tetraacetic acid,
(L-11) 2,4-pentanediamine tetraacetic acid, and
(L-12) 2-methyl-2,4-pentanediamine tetraacetic acid As for the ferric complex salts of the above-given compounds (L-1) through (L-12), the sodium salts, potassium salts or ammonium salts of these ferric complexes may arbitrarily be used. Among them, the ammonium salts thereof are desirably used from the viewpoints of the effects of the objects of the invention and the solubility.

Among the above-given examples of the compounds, those particularly desirable for the invention include (L-1), (L-3), (L-4), (L-5) and (L-9) and, inter alia, (L-1) is particularly more desirable.

In the invention, a tablet-shaped processing agent may be applied with the ferric complexes of the following compounds as well as the iron complexes of the compounds represented by the foregoing Formula (L).

(L'-1) Ethylenediamine tetraacetic acid,
(L'-2) Trans-1,2-cyclohexanediamine tetraacetic acid,
(L'-3) Dihydroxyethyl glycinic acid,
(L'-4) Ethylenediamine tetrakismethylene phosphonic acid,
(L'-5) Nitrilotrismethylene phosphonic acid,
(L'-6) Diethylenetriamine pentakismethylene phosphonic acid,
(L'-7) Diethylenetriamine pentaacetic acid,
(L'-8) Ethylenediamine diorthohydroxyphenyl acetic acid,
(L'-9) Hydroxyethyl ethylenediamine triacetic acid,
(L'-10) Ethylenediamine dipropionic acid,
(L'-11) Ethylenediamine diacetic acid,
(L'-12) Hydroxyethyliminodiacetic acid,
(L'-13) Nitrilotriacetic acid,
(L'-14) Nitrilotripropionic acid,
(L'-15) Triethylenetetramine hexaacetic acid, and
(L'-16) Ethylenediamine tetrapropionic acid The above-given ferric complexes of organic acids may be added in a proportion within the range of, desirably, 0.01 to 2.0 mols per 1000 ml of a bleacher or a bleach-fixer used and, more desirably, 0.015 to 1.5 mols/liter thereof.

From the viewpoint of the offensive smell in the working environment, the bleachers relating to the invention are desired to have no acetic acid substantially.

From the viewpoints of the stability of the processing characteristics and the bleaching fogginess, the bleachers relating to the invention are desired to contain the compounds represented by the following Formula (C).

$$A_5\text{-}(\text{COOM})_n \qquad \text{Formula (C)}$$

wherein n is an integer of not less than 2; $A_5$ represents a univalent group or a divalent group when n is 2 and $A_5$ represents a trivalent group when n is 3; and M represents an alkali-metal atom or another cation, provided, n numbers of Ms may be the same with or the different from each other.

The typical examples of the compounds represented by Formula [C] will be given below. It is, however, to be understood that the invention shall not be limited thereto.

(C-1) $HOOCCH_2C(OH)(COOH)CH_2COOH$
(C-2) $HOOC(CHOH)_2COOH$
(C-3) $HOOCCH_2COOH$
(C-4) $HOOCCH(OH)CH_2COOH$
(C-5) $HOOCCH{=}CHCOOH$
(C-6) $HOOCCH_2CH_2COOH$
(C-7) $(COOS)_2$ (C-8)

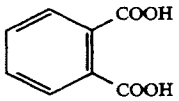

(C-9)

-continued

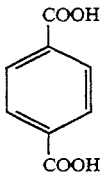

(C-10) $NaOOCCH{=}CHCOONa$
(C-11) $KOOCCH{=}CHCOOK$
(C-12) $H_4NOOCCH{=}CHCOONH_4$ (C-13)

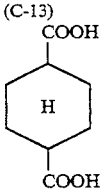

(C-14)

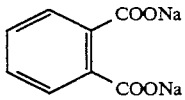

(C-15)

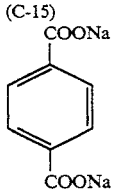

(C-16)

$HOOC\text{-}(CH_2)_3\text{-}COOH$

Among the above-given exemplified compounds, the desired ones include, for example, exemplified compounds (C-3), (C-4), (C-5) and (C-6).

The compounds represented by Formula (C) may be used either in the form of an acid or in the form of a potassium salt, a sodium salt, an ammonium salt, a lithium salt or a triethanol ammonium salt.

The compounds represented by Formula (C) are to be contained in an amount within the range of, desirably, 0.05 to 2.0 mols and, more desirably, 0.2 to 1.0 mol per liter of a processing tank solution having a bleaching function.

When a bleacher, a bleach-fixer or a fixer contains the imidazole and the derivatives each described in JP OPI Publication No. 64-295258/1989 or the compounds represented by Formulas (I) through (IX) given in the same Patent Publication, and at least one kind of these exemplified compounds, the rapid processing effect can be displayed.

Besides the above-described accelerators, the exemplified compounds given in JP OPI Publication No. 62-123459/1987, pp. 51~115; the exemplified compound given in JP OPI Publication No. 63-17445/1988, pp. 22~25; and the compounds given in JP OPI Publication Nos. 53-96530/1978 and 5328426/1978, each may similarly be used.

A bleacher or a bleach-fixer may also contain, besides the above, a halide such as ammonium bromide, potassium. bromide and sodium bromide, various kinds of fluorescent whitening agents, defoamers or surfactants.

In the fixer or the bleach-fixer of the invention, thiocyanates and thiosulfates are desirably used. Thiocyanates may desirably be contained in a proportion of at least not less than 0.1 mol/liter. When processing a color negative film, they are contained in a proportion of, more desirably, not less than 0.5 mol/liter and, particularly, not less than 1.0 mol/liter. Thiosulfates may be contained in a proportion of at least 0.05 mol/liter. When processing a color negative film, they may be contained more desirably in a proportion of not less than 0.1 mol/liter. Further in the invention, when making combination use of both thiocvanates and thiosulfates, the objects of the invention can further effectively be achieved.

The fixers or bleach-fixers each relating to the invention may contain a pH buffer comprising various kinds of salts independently or in combination, besides the above-mentioned fixing agents. It is further desired to contain therein a large number of rehalogenating agents including, for example, alkali halides or ammonium halides such as potassium bromide, sodium bromide, sodium chloride and ammonium bromide. It is also allowed to add suitably the compounds such as alkylamines and polyethylene oxides which have been known as the compounds to be ordinarily added to a fixer or a bleach-fixer.

It is desired that a fixer or a bleach-fixer is added to the compounds given in JP OPI Publication No. 64-295258/1989, which are represented by Formula (FA) and the exemplified compounds FA-1 through FA-39. When this is the case, not only the effects of the invention can be displayed more effectively, but also another effect can also be so enjoyed as to remarkably reduce any sludges produced in a processing solution having a fixing function when a small quantity of light sensitive materials are processed extending for a long period of time.

The compounds represented by Formula (FA) given in the above-mentioned Patent Publication can be synthesized in such an ordinary procedures described in U.S. Pat. Nos. 3,335,161 and 3,260,718. The compounds represented by the above-given Formula (FA) may be used independently or in combination. When these compounds are added in an amount within the range of 0.1 to 200 g per 1000 ml of a processing solution used, an excellent result can be enjoyed.

The tablet-shaped processing agent of the invention can be prepared in any ordinary procedures described in, for example, JP OPI Publication Nos. 51-61837/1976, 52-88025/1977 and 54-155038/1979 and British Patent No. 1,213,808.

The tablet of the invention is molded in a specific form by applying pressure to powder or granule.

To be more concrete, a plurality of solid agents applicable to the photographic processes relating to the invention are mixed up uniformly with a mixer and are then pulverized, so that they are granulated by making use of a fluidized-bed spray type granulating machine. The resulting granulated products and the other granulated products comprising plural solid agents separately prepared in the above-described procedures are mixed up and tableted, so that a tablet-shaped processing agent is prepared.

From the viewpoints of the solubility and strength of the tablet-shaped processing agents of the invention, the bulk density thereof is to be within the range of, desirably, 1.00 to 3.00 g/cm$^3$ and, more desirably, 1.10 to 2.50 g/cm$^3$.

In the invention, when the processing agent is a color developer, a color developing agent desirably applicable thereto is a p-phenylene diamine type compound having a water-soluble group, because it can excellently display the effects of the objects of the invention and can reduce fog production.

As compared to a paraphenylene diamine type compound not having any water-soluble group, such as N,N-diethyl-p-phenylene diamine, the p-phenylene diamine type compounds each having a water-soluble group not only have such an advantage that any light sensitive materials are not contaminated and any human skin is not poisoned even if it adheres to the skin, but also more effectively achieve the objects of the invention particularly when it is used in combination with the color developer of the invention.

The above-mentioned water-soluble groups include those among which at least one is on the amino group or benzene nucleus of a p-phenylene diamine type compound. The typical water-soluble groups include, desirably, $-(CH_2)_nCH_2OH-$, $-(CH_2)_mNHSO_2(CH_2)_nCH_3$, $-(CH_2)_mO(CH_2)_nCH_3$, $-(CH_2CH_2O)_nC_mH_{2m+1}$ (in which m and n are each an integer of not less than O, —COOH group and $-SO_3H$ group.

The typical exemplified compounds of the color developing agents desirably applicable to the invention include Compounds (C-1) through (C-16) given in JP OPI Publication No. 4-86741/1992, pp. 26~31 and 4-amino-3-methyl-N-(3-hydroxy propyl)aniline.

Further, the color developing agents desirably applicable include, particularly, the following compounds Dev-1 through Dev-3.

Dev-1

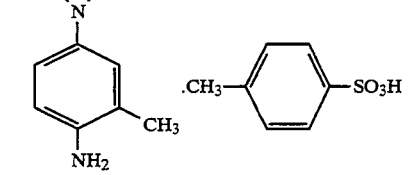

Dev-2

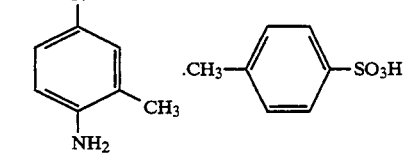

Dev-3

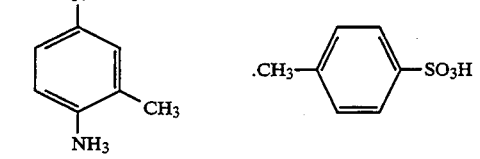

The above-mentioned color developing agents are generally used in the form of salts such as a hydrochloride, a sulfate or a p-toluene sulfonate.

In the invention and when a compound represented by the following Formulas (A) and (B) is contained in the color developing solution relating to the invention, not only the effects of the invention can further be displayed, but also the effect of reducing the fog produced in unexposed areas can be displayed. Therefore, this case is one of the desired embodiments of the invention.

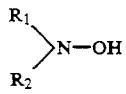

Formula (A)

wherein $R_1$ and $R_2$ represent each an alkyl group, an aryl group, an $R_3CO$— group or a hydrogen atom, provided that both of $R_1$ and $R_2$ shall not be hydrogen atoms at the same time or $R_1$ and $R_2$ may form a ring.

In the above-given Formula (A), the alkyl groups represented by $R_1$ and $R_2$ may be the same with or the different from each other, however, they are desired to have 1 to 3 carbon atoms, respectively. Further, the alkyl groups are allowed to have a carboxyl group, a phosphoric acid group, a sulfo group or a hydroxyl group, respectively. $R_3$ represents an alkoxy group, an alkyl group or an aryl group. The alky groups and aryl groups represented by $R_1$, $R_2$ and $R_3$ include those having each a substituent. The rings allowed to be formed by $R_1$ and $R_2$ include a heterocyclic ring such as those of piperidine, pyridine, triazine or morpholine.

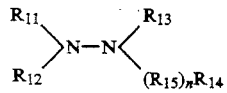

Formula (B)

wherein $R_{11}$, $R_{12}$ and $R_{13}$ represent each a hydrogen atom, a substituted or non-substituted alkyl, aryl or heterocyclic group; $R_{14}$ represents a hydroxyl group, a hydroxyamino group or a substituted or non-substituted alkyl, aryl, heterocyclic, alkoxy, aryloxy, carbamoyl or amino group. The heterocyclic groups have each a 5- or 6-membered ring. They are comprised of C, H, O, N, S or halogen atom and may also be saturated or unsaturated; $R_{15}$ represents a divalent group selected from the group consisting of —CO, —$SO_2$— or —C(=CH)—; and n is an integer of 0 or 1, provided that, when n=0, $R_{14}$ represents a group selected from the group consisting of alkyl groups, aryl groups and heterocyclic groups and that $R_{13}$ and $R_{14}$ may also be associated to form a heterocyclic ring.

The typical examples of the hydroxyl amine type compounds represented by the foregoing Formula (A) are given in U.S. Pat. Nos. 3,287,125, 3,329,034 and 3,287,124. The particularly desirable exemplified compounds include Compounds (A-1) through (A-39) given in JP OPI Publication No. 4-86741/1992, pp. 36~38, Compounds (1) through (53) given in JP OPI Publication No. 3-33845/1991, pp. 3~6 and Compounds (1) through (52) given in JP OPI Publication No. 3-63646/1991, pp. 5~7.

Next, the typical examples of the compounds represented by the foregoing Formula (B) include Compounds (B-1) through (B-33) given in JP Application No. 2-203169/1990, pp. 40~43 and Compounds (1) through (56) given in JP OPI Publication No. 3-33846/1991, pp. 4~6.

The compounds represented by Formula (A) or (B) are generally used in the form of a free amine, a hydrochloride, a sulfate, a p-toluene sulfonate, an oxalate, a phosphate or an acetate.

The hydroxyl amine type compounds represented by the following Formula (A') may also desirably be used as the preservatives for color developers.

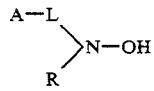

Formula (A')

wherein L represents a substitutable alkylene group; A represents a carboxyl group, a sulfo group, a phosphono group, a phosphino group, a hydroxyl group or an alkyl-substitutable amino, amido, carbamoyl or sulfamoyl group; and R represents a hydrogen atom or a substitutable alkyl group.

The typical examples of the compounds represented by Formula (A') include Compounds (1) through (54) given in JP OPI Publication No. 3-184044/1991, the lower left column of p. 4 to the lower right column of p. 6. Among these examples, the compounds represented by the following structures (1) and (7) are desirable.

(1) $HON(CH_2CH_2COOH)_2$ (7) $HON(CH_2CH_2SO_3H)_2$

The compounds represented by Formula (A') may be prepared by making an alkylation reaction of a hydroxyl amine available on the market. For example, they may be synthesized in the synthesizing procedures detailed in West German Patent No. 1,159,634 or Inorganica Chimica Acta, 93 (1984) , pp. 101~108.

In the color developers and black-and-white developers each relating to the invention, a small amount of a sulfite may be used for a preservative. Such a sulfite include, for example, sodium sulfite, potassium sulfite, sodium bisulfite and potassium bisulfite.

In the color developers and black-and-white developers each relating to the invention, a buffer is to be used. The buffers include, for example, sodium carbonate, potassium carbonate, potassium bicarbonate, trisodium phosphate, tripotassium phosphate, disodium phosphate, dipotassium phosphate, sodium borate, potassium borate, sodium tetraborate (or boric acid), potassium tetraborate, sodium o-hydroxybenzoate (or sodium salicylate), potassium o-hydroxybenzoate, sodium 5-sulfo-2-hydroxybenzoate (or sodium 5-salicylate) and potassium 5-sulfo-2-hydroxybenzoate (or potassium 5-sulfosalicylate).

The development accelerators include, for example; thioether type compounds typified by those given in JP Examined Publication Nos. 37-16088/1962, 37-5987/1962, 38-7826/1963, 44-12380/1969 and 45-9019/1970 and U.S. Pat. No. 3,813,247; p-phenylene diamine type compounds typified by those given in JP OPI Publication Nos. 52-49829/1977 and 50-15554/1975; quaternary ammonium salts typified by those given in JP Examined Publication No. 44-30074/1969 and JP OPI Publication Nos. 50-137726/1975, 56-156826/1981 and 52-43429/1977; p-aminophenols given in U.S. Pat. Nos. 2,610,122 and 4,119,462; amine type compounds given in U.S. Pat. Nos. 2,494,903, 3,128,182, 4,230,796 and 3,253,919, JP Examined Publication No. 41-11431/1966 and U.S. Pat. Nos. 2,482,546, 2,596,926 and 3,582,346; polyalkylene oxides typified by those given in JP Examined Publication Nos. 37-16088/1962 and 42-25201/1967, U.S. Pat. No. 3,128,183, JP Examined Publication Nos. 41-11431/1966 and 42-23883/1967 and U.S. Pat. No. 3,532,501; and, besides the above, a 1-phenyl-3-pyrazolidone, a hydrazine, a mesoionic type compound, an ionic type compound and an imidazole. They may be so added as to meet the requirements.

For the purposes of preventing a fog production and so forth, chlorine ion and bromine ion may also be applied to a color developer. In the invention, chlorine ions are contained in a proportion within the range of, desirably, $1.0\times10^{-2}$ to $1.5\times10^{-1}$ mols/liter and, more desirably, $3.5\times10^{-2}$ to $1\times10^{-1}$ mols/liter of a color developer used. When a chlorine ion concentration is more than $1.5\times10^{-1}$ mols/liter, a development is retarded and it is therefore not suitable to rapidly obtain a high maximum density. When it is less than $3.5\times10^{-2}$ mols/liter, a stain is produced and it is therefore not suitable, because the serious variations of the photographic characteristics (including particularly the minimum density) are derived from a series of continuous processing treatments.

In the invention, a color developer contains bromine ions in a proportion within the range of, desirably, $3.0\times10^{-5}$ to $1.0\times10^{-3}$ mols/liter, more desirably, $5.0\times10^{-5}$ to $5\times10^{-4}$ mols/liter and, particularly, $1\times10^{-4}$ to $3\times10^{-4}$ mols/liter. When a bromine ion concentration is more than $1\times10^{-3}$ mols/liter, a development is retarded and both of a maximum density and a sensitivity are lowered. When it is less than $3.0\times10^{-5}$ mols/liter, a stain is produced and it is therefore not suitable, because the serious variations of the photographic characteristics (including particularly the minimum density) are derived from a series of continuous processing treatments.

When these ions are added directly into a color developer, the chlorine ion supplying materials may include sodium chloride, potassium chloride, ammonium chloride, nickel chloride, magnesium chloride, manganese chloride, calcium chloride and cadmium chloride. Among these materials, sodium chloride and potassium chloride may be preferred.

They may also be supplied in the form of the counter salts of a fluorescent whitening agent which is to be added into a color developer and a developer.

The bromine ion supplying materials include sodium bromide, potassium bromide, ammonium bromide, lithium bromide, calcium bromide, magnesium bromide, manganese bromide, nickel bromide, cadmium bromide, cerium bromide and thallium bromide. Among these materials, potassium bromide and sodium bromide may be preferred.

If required, the color developers and developers of the invention are each allowed to be further added with any desired antifoggant, besides the above-given chlorine ions and bromine ions. The antifoggants applicable thereto include an alkali-metal halide such as potassium iodide and an organic antifoggant. The organic antifoggants may be typified by nitrogen-containing heterocyclic compounds including, for example, benzotriazole, 6-nitrobenzoimidazole, 5-nitroisoindazole, 5-methylbenzotriazole, 5-nitrobenzotriazole, 5-chlorobenzotriazole, 2-thiazolylbenzo imidazole, 2-thiazolylmethylbenzoimidazole, indazole, hydroxyazaindolidine and adenine.

From the viewpoint of displaying the effects of the objects of the invention, it is desired to add a triazinyl stilbene type fluorescent whitening agent in the color developers and developers each of the invention. The fluorescent whitening agents include, desirably, the compounds represented by the following Formula (E).

Formula (E)

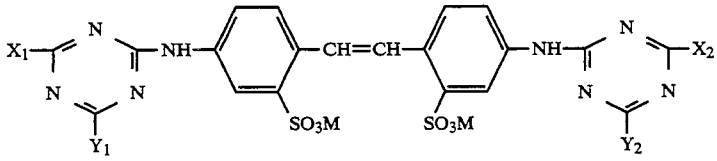

wherein $X_1$, $X_2$, $Y_1$ and $Y_2$ represent each a hydroxyl group, a halogen atom such as a chlorine atom or bromine atom, an alkyl group, an aryl group, a $-N(R_{21})(R_{22})$ group,

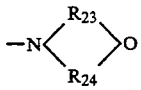

or $OR_{25}$, in which $R_{21}$ and $R_{22}$ represent each a hydrogen atom, an alkyl group (including those substituted) or an aryl group (including those substituted); $R_{23}$ and $R_{24}$ represent each an alkylene group (including those substituted); $R_{25}$ represents a hydrogen atom, an alkyl group (including those substituted) or an aryl group (including those substituted); and M represents an alkali metal atom or an ammonium group.

The details of the groups represented by Formula (E) and the substituents thereof are synonymous with those described in JP OPI Publication No. 4-118649/1992, the 8th line from the bottom of p. 62 to the 3rd line from the bottom of p. 64. The typical compounds thereof may include Compounds E-1 through E-45 given in the same Patent Publication, pp. 65~67.

Among them, those desirably applicable thereto include, particularly, E-4, E-24, E-34, E-35, E-36, E-37 and E-41. These compounds may be added in an amount within the range of, desirably, 0.2 to 10 g per 1000 ml of a color developer used and, more desirably, 0.4 to 5 g.

If required, the color developers and black-and-white developers each applicable to the invention are further allowed to make combination use with methyl cellosolve, methanol, acetone, dimethyl formamide, β-cyclodextrin and, besides, the compounds given in JP Examined Publication Nos. 47-33378/1972 and 44-9509/1969 so as to serve as an organic solvent for increasing the solubility of a developing agent used.

Further, an auxiliary developer may also be used together with a developing agent. The known auxiliary developers include, for example, N-methyl-p-aminophenol hexasulfate (or Metol), Phenidone, N,N-diethyl-p-aminophenol hydrochloride and N,N,N',N'-tetramethyl-p-phenylene diamine hydrochloride. They may usually be added in an amount within the range or, desirably, 0.01 to 1.0 g/liter.

Still further, a variety of additives such as an antistaining agent, an antisludging agent and an interlayer-effect accelerator may be used therein, besides the above.

From the viewpoint of effectively achieving the objects of the invention, the color developers and black-and-white developers are each desired to contain the chelating agent represented by the following Formula (K) given in JP OPI Publication No. 4-118649/1992, the 9th line from the bottom of p. 69 to p. 74 and the exemplified compounds K-1 through K-22 given therein.

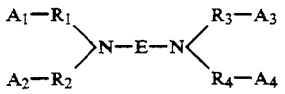

Formula (K)

wherein E represents a substituted or unsubstituted alkylene, cycloalkylene, or phenylene group, $—R^5OR^5—$, $—R^5OR^5OR^5—$, $—R^5ZR^5—$; $R^1$ through $R^5$ represent a substituted or unsubstituted alkylene group; Z represents $=N—R^5—A^5$ or $=N—A^5$; and $A^1$ through $A^5$ represent a hydrogen atom, a hydroxyl group, $—COOM^1$ or $—PO_3(M^1)_2$ wherein $M^1$ represents a hydrogen atom or an alkali metal atom.

Among the above-mentioned chelating agents, K-2, K-9, K-12, K-13, K-17 and K-19 may desirably be used and, in particular, when K-2 and K-9 are added into a color developer, the effects of the invention can be displayed more excellently.

These chelating agents may be added in an amount within the range of, desirably, 0.1 to 20 g per 1000 ml of a color developer or a black-and-white developer and, more desirably, 0.2 to 8 g.

Further, the color developers and black-and-white developers are also allowed to contain each of anionic, cationic, amphoteric or nonionic surfactants. If required, it is further allowed to add various kinds of surfactants such as alkyl sulfonic acid, aryl sulfonic acid, aliphatic carboxylic acid and aromatic carboxylic acid.

Next, the light sensitive materials applicable with the processing agents of the invention will now be detailed below.

When a light sensitive material is for photographic use, silver iodobromide or silver iodochloride each having an average silver iodide content of not less than 3 mol % may be used as the silver halide grains thereof. Among them, silver iodobromide containing silver iodide in a proportion within the range of 4 to 15 mol % may desirably be used. Particularly, the average silver iodide content thereof suitable for the invention are within the range of, desirably, 5 to 12 mol % and, preferably, 8 to 11 mol %.

As for the silver halide emulsions applicable to the light sensitive materials which are to be processed with the photographic processing agents of the invention, those described in Research Disclosure No. 308119 (hereinafter abbreviated to as RD308119) may be used. The places of the descriptions will be given below.

| [Item] | [Page of RD308119] |
|---|---|
| Iodine composition | 993 I-A |
| Preparation procedures | 993 I-A, 994 E |
| Crystal habit, | |
| Regular | 993 I-A |
| Twinned | " |
| Epitaxial | " |
| Halogen composition, | |
| Uniform | 993 I-B |
| Not uniform | " |
| Halogen conversion | 994 I-C |
| Halogen substitution | " |
| Metal content | 994 I-D |
| Monodispersion | 995 I-F |
| Solvent addition | " |
| Latent-image formed position, | |
| Surface | 995 I-G |
| Interior | " |
| Applicable light sensitive material, | |
| Negative | 995 I-H |
| Positive (including internally fogged grains) | " |
| Application upon mixing with emulsions | 995 I-J |
| Demineralization | 995 II-A |

As for the silver halide emulsions, those physically, chemically and spectrally sensitized are used. The additives applicable to the processing steps mentioned above are detailed in Research disclosure Nos. 17643, 18716 and 308119 (hereinafter abbreviated to as RD17643, RD18716 and RD308119, respectively). The places of the descriptions will be given below.

| | Page of | | |
|---|---|---|---|
| [Item] | [RD308119] | [RD17643] | [RD18716] |
| Chemical sensitizer | 996 III-A | 23 | 648 |
| Spectral sensitizer | 996 IV-A-A,B, C,D,E,H,I,J | 23~24 | 648~9 |
| Super sensitizer | 996 IV-A-E,J | 23~24 | 648~9 |
| Antifoggant | 998 VI | 24~25 | 649 |
| Stabilizer | 998 VI | 24~25 | 649 |

The photographic additives are also detailed in the above-given Research Disclosures. The places of the descriptions are given below.

| | Page of | | |
|---|---|---|---|
| [Item] | [RD308119] | [RD17643] | [RD18716] |
| Color-stain inhibitor | 1002 VII-I | 23 | 648 |
| Dye-image stabilizer | 1001 VII-J | 25 | |
| Whitening agent | 998 V | 24 | |
| UV absorbent | 1003 VIII C, XIII C | 25~26 | |
| Light absorbent | 1003 VIII | 25~26 | |
| Light diffuser | 1003 VIII | | |
| Filter dye | 1003 VIII | 25~26 | |
| Binder | 1003 IX | 26 | 651 |
| Antistatic agent | 1006 XIII | 27 | 650 |
| Layer hardener | 1004 X | 26 | 651 |
| Plasticizer | 1006 XII | 27 | 650 |
| Lubricant | 1006 XII | 27 | 650 |
| Activator, Coating aid | 1005 XI | 26~27 | 650 |
| Matting agent | 1007 X VI | | |
| Developing agent (contained in a light sensitive material) | 1011 XX-B | | |

The light sensitive materials to be processed with the photographic processing agents of the invention can be applied with a variety of couplers. The typical examples of the couplers are given in the foregoing Research Disclosures. The places of the descriptions will be given below.

| [Item] | Page of [RD308119] | [RD17643] |
|---|---|---|
| Yellow coupler | 1001 VII-D | VII C~G |
| Magenta coupler | 1001 VII-D | VII C~G |
| Cyan coupler | 1001 VII-D | VII C~G |
| DIR coupler | 1001 VII-F | VII F |
| BAR coupler | 1002 VII-F | |
| Other useful residual group-releasing coupler | 1001 VII-F | |
| Alkali-soluble coupler | 1001 VII-E | |

The above-given additives may be added in the dispersion procedures detailed in RD308119, XIV and so forth.

In the invention, it is allowed to use the supports detailed in the foregoing RD17643, p. 28, RD18716, pp. 647~648 and RD308119, XIX.

The light sensitive materials can be provided with auxiliary layers such as a filter layer detailed in the foregoing RD308119, VII-K and an interlayer. Further, the light sensitive materials may take a variety of layer arrangements such as normal, reversal and unit layer arrangements.

Next, the color light sensitive materials desirably applicable with the photographic processing agents of the invention will be detailed below.

As for the silver halide grains contained in a light sensitive material, those principally comprising silver chloride of at least 80 mol % or more, desirably 90 mol % or more and, more desirably, 95 mol % or more, can be used.

The above-mentioned silver halide emulsions principally comprising silver chloride may further contain, besides silver chloride, silver bromide and/or silver iodide as the silver halide composition. In this case, the silver bromide content thereof is desirably not more than 3 mol % more desirably, not more than 10 mol % and, further desirably, not more than 3 mol %. When containing silver iodide therein, the silver iodide content is, desirably, not more than 1 mol %, more desirably, not more than 0.5 mol % and, preferably, zero. The above-mentioned silver halide grains principally comprising silver chloride in a content of not more than 50 mol % are desirably applied to at least one silver halide emulsion layer and, more desirably, to the whole light-sensitive silver halide emulsion layer.

The crystals of the foregoing silver halide grains may be regularly crystallized, twin-crystallized or other. Any one of the desired ratios of [1.0.0] face to [1.1.1] face may be applied. Further, the crystal structures of these silver halide grains may be uniform from the interior to the exterior of the grains or may also be different in the layer (or phase) structures (of the core/shell type) between the interior and the exterior of the grains. Still further, these silver halide grains may be of the type of forming a latent image mainly on the surfaces of the grains or of the type of forming a latent image inside the grains. In addition to the above, tabular-shaped silver halide grains (see JP OPI Publication Nos. 58-113934/1983 and 61-47959/1986) may also be used. Besides the above, the silver halides detailed in JP OPI Publication Nos. 64-26837/1989, 64-26838/1989 and 64-77047/1989 may also be used.

The above-mentioned silver halide grains may be those prepared in any one of an acid process, a neutral process and an ammoniacal process. Or, they may also be prepared in such a manner that seed grains are prepared in an acid process and are then grown up in an ammoniacal process having a faster growing rate so as to grow them up to a desired size. When growing silver halide grains up, it is desired to control the pH and pAg in a reaction chamber and silver ions and halide ions are then jetted and mixed together in the chamber, successively and at the same time, so that the amounts of the ions jetted in may meet the growing rate of the silver halide grains, as described in, for example, JP OPI Publication No. 54-48521/1979.

When a light sensitive material to be processed with the photographic processing agents of the invention is for color photographic use, the silver halide emulsion layers thereof contain each a color coupler.

A red light sensitive layer is allowed to contain, for example, a non-diffusible cyan coupler capable of producing a partially cyan-colored image, such as, generally, a naphthol type or α-naphthol type coupler.

A green light sensitive layer is allowed to contain, for example, at least one non-diffusible magenta coupler capable of producing a partially magenta-colored image, such as, ordinarily, a 5-pyrazolone type coupler and a pyrazolotriazole type coupler. A blue light sensitive layer is allowed to contain, for example, at least one non-diffusible yellow coupler capable of producing a partially yellow-colored image, such as, generally, a coupler having an open-chained ketomethylene group. These couplers may be any one of 6-, 4- or 2-equivalent couplers, for example.

In the color light sensitive materials applicable with the photographic processing agents of the invention, a 2-equivalent coupler is particularly desirable to be contained.

The suitable couplers are disclosed in, for example, the following publications; namely, W Pelz, 'Farbkuppler' reported in 'Mitteilungen aus den Forschungslaboratorien der Agfa', Leverkusen/Munchen, Vol. III, p. 111, (1961); K. Venkataraman, 'The Chemistry of Synthetic Dyes', Vol. 4, pp. 341~387, Academic Press; 'The Theory of the Photographic Process', 4th Ed, pp. 353~362; and 'Research Disclosure', No. 17643, VII.

In the color light sensitive materials applicable with the photographic processing agents of the invention, it is desired, from the viewpoint of the effects of the invention, to use a magenta coupler such as those represented by Formula [M-1] given in JP OPI Publication No. 63-106655/1988 (including the typically exemplified magenta couplers No. 1 through No. 77 given in the same publication, pp. 29~34); the cyan couplers represented by Formula (C-I) or (C-II) given in the same publication, p. 34 [including the typically exemplified cyan couplers (C'-1) through (C'-82) and (C''-1) through (C''-36) each given in the same publication, pp. 37~42]; the high-speed yellow couplers given in the same publication, p. 20 (including the typically exemplified yellow couplers (Y'-1) through (Y'-39) given in the same publication, pp. 21~26.

The color light sensitive material applicable with the photographic processing agents of the invention is preferably a color paper comprising silver chloride in an amount of not less than 80 mol %.

After a silver halide photographic light sensitive material is exposed to light, it is processed in the processing steps such as a developing step, a desilvering step, a washing step and a stabilizing step. A black-and-white developer or a color developer is used in the developing step; a bleacher, a bleach-fixer or a fixer, in the desilvering step; a city water or ion-exchange water, in the washing step; and a stabilizer, in the stabilizing step, respectively. Each of the processing solutions is thermostated usually within the range of 30° to 40° C. and the light sensitive materials subject to the processing are dipped in these processing solutions and then processed.

The above-mentioned processes are commonly carried out through an automatic processing machine (hereinafter referred to as an automatic processor) in which the light sensitive materials are conveyed in order from a processing tank to another successive processing tank each containing the above-mentioned processing solution, respectively.

When this is the case, a system of supplying the replenishers to the respective processing solutions is adopted to keep constant the activities of the processing solutions contained in the corresponding processing tanks.

To be more concrete, the processing operations are carried out while timely supplying the replenishers from the corresponding replenisher tanks into the processing tanks, respectively.

In the above-mentioned case, there are two replenishing methods; one method in which a replenisher itself is prepared in another place in advance and is then reserved in its own replenisher tank as required; and the other method in which the replenisher is prepared directly in the replenisher tank.

The processing agents are supplied in the form of powder or a concentrated solution and are then dissolved or diluted in a specific amount of water, so that they may be used.

The control of the replenishing rate is essential for stabilizing the finished quality of a light sensitive material after it is processed through an automatic processor.

For controlling the replenishing rate, it is needed to check up a periodical replenishing amount. Recently, however, it is the actual situation that such a checking-up can hardly be performed at most of the mini-labs. Therefore, no checking-up remains performed until the replenishing rate is noticed to be out of the allowable range.

When the tablets of the invention are processed in combination with an automatic processor capable of solving the above-mentioned problems, the effects of the invention can excellently be displayed.

Next, the above-mentioned automatic processor will be detailed below.

FIG. 1 is a schematic illustration showing an example of the automatic processors, wherein the control mechanism of a color negative film processing unit is schematically illustrated.

A color negative film is inserted into light sensitive material insertion section 13 and then passes through light sensitive material area detective sensor 7. When a specific area is detected, tablet-shaped processing agent supplying unit 8, replenishing water supplying unit 10 and electromagnetic valve 12 are operated upon receipt of the signal from control section 11, so that a processing agent for replenishment and replenishing water for preparing the solution are each supplied in an amount required into processing tanks 1, 2, 3 and 5, respectively.

When the automatic processor is kept thermally controlled for some hours, processing solutions are evaporated from each of processing tanks 1 through 5 so as to lower the solution levels down to not higher than the specific levels. At that moment, solution level detector 9 is operated to operate replenishing water supplying unit 10 and electromagnetic valve 12 upon receipt of the signal from control section 11, so that replenishing water for compensating the evaporation may be supplied until the uppermost level limit detection mechanism of solution level detection sensor 9 begins to operate. Also, hot washing water 14, that is replenishing water supplied from replenishing water supply pipe 15, is desirable to be temperature controlled together with replenishing water for preparing solutions and replenishing water for compensating the evaporation. Further, in each of processing tanks 1 through 5, 1 is a color developing tank, 2 is a bleaching tank, 3 is a fixing tank, 4 is a washing tank and 5 is a stabilizing tank, respectively. In addition, 6 is a drying section.

Figure 2:
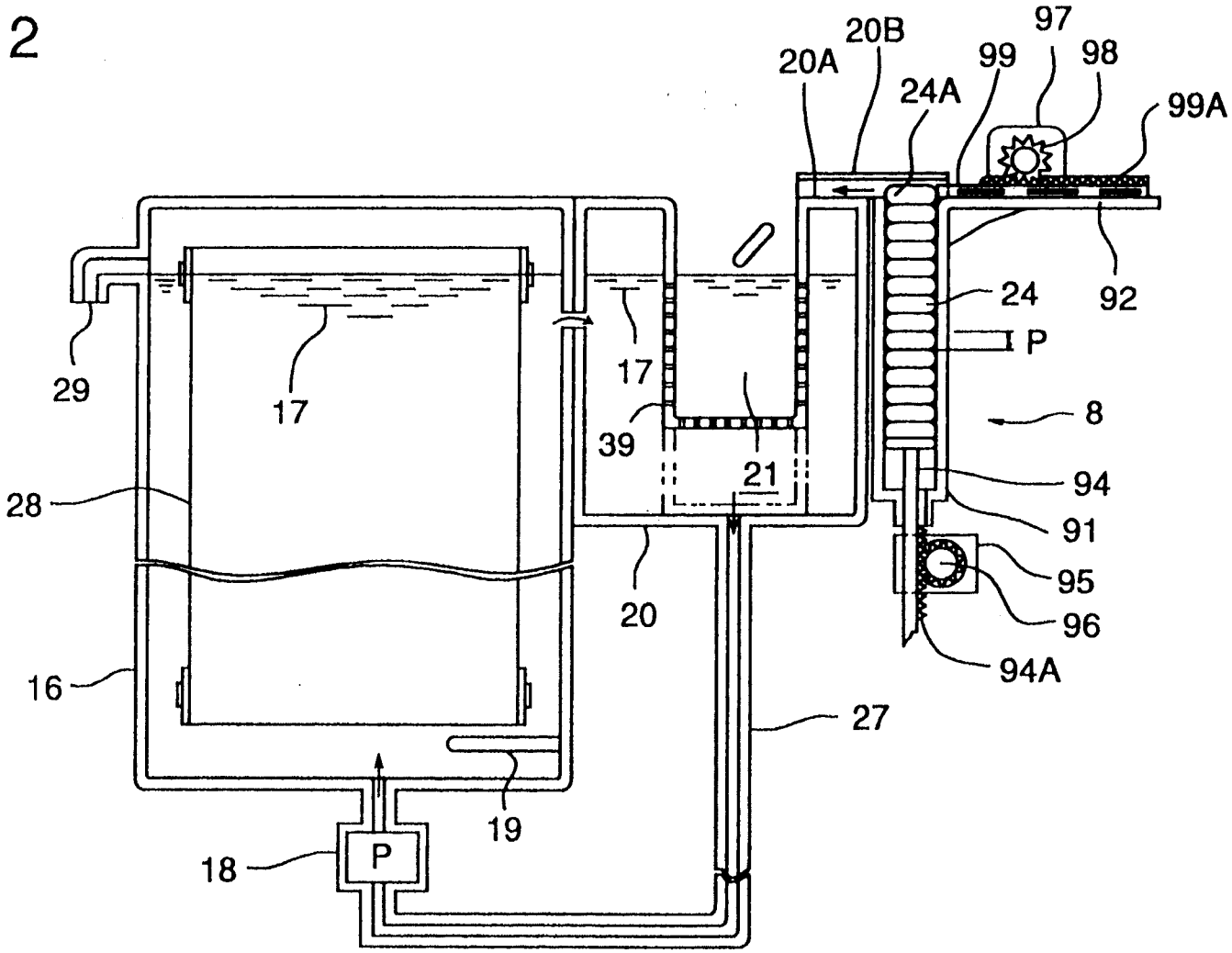
FIG. 2 is a schematic illustration of a processing tank attached with a tablet-shaped processing agent supply unit.

FIG. 2 shows tablet-shaped processing agent supply unit 8 in the form of a schematic illustration.

Upon receipt of the signal from light sensitive material area detective sensor 7, control section 11 is operated and when tablet-shaped processing agent supply stepping motor 95 is then operated, driving pinion 96 directly connected to the motor 95, which is coupled to rack 94A of tablet-shaped processing agent supply extrusion plunger 94, such driving pinion 96 lifts plunger 94 having the rack 94A up by one seep that is a pitch length P of the processing agent, so that the uppermost tablet-shaped processing agent 24 stored in the processing agent supply tray 91 can be stood ready at the tablet dropping position. Therefore, one piece of tablet-shaped processing agent 24 stored in supply tray 91 is completely made ready to be dropped into the inside of filter unit 21 provided into processing agent supply tank (hereinafter referred to as a subtank) that is the processing agent dissolving section.

As described above, tablet-shaped processing agent 24A standing ready at the uppermost position is slid in the lateral direction through a tunnel formed of guide plate 20A and top cover 20B each provided to the upper part of subtank 20, by the forwarding movement of plunger 99 which can reciprocate horizontally over piston sliding table 92, so that the processing agent may be dropped on the surface of a solution in filter unit 21 of subtank 20. A part of plunger 99 is carved into rack 99A which is engaged with pinion 98 directly coupled to the foregoing stepping motor 97. When the stepping motor 97 starts in operation by a demand signal, the reciprocating movements thereof are started in operation. When tablet-shaped processing agent 24A is dropped completely into subtank 20 by a forwarding movement, the stepping motor 97 is reversely rotated and, thereby, plunger 99 is moved backward so as to restore the original position and is then stood ready until the next demand signal is received. There may be some instances where a demand signal may demand supply of a plurality of tablet-shaped processing agents. If this is the case, the above-described operation is repeated specific times. Tablet-shaped processing agents 24 thus supplied are gradually dissolved and are then supplied into main processing tank 16 by circulation pump 18. In addition, the solubility of tablet-shaped processing agents 24 can be more improved when the whole or a major part of the circulation flow of processing solution 17 being circulated between main processing tank 16 and subtank 20 by circulation pump 18 is directly made to pass through filter unit 21 provided inside subtank 20. In the figure, 19 is a thermostat heater, 27 is a communication pipe connecting main processing tank 16 and subtanks 20, 28 is a processing rack and 29 is an overflow outlet.

In the above-mentioned constitution, supply tray 91 of tablet-shaped processing agent supply unit 8 is so structured as to be covered by vertical walls around the four quarters so that plunger 94 can be reciprocated up and down from the bottom. Thus, tablet-shaped processing agents 24 are protected to be kept in the almost tightly closed state in supply tray 91 and, further, the uppermost tablet-shaped processing agent 24A is also extruded to subtank 20 through the tunnel, being kept it in the almost tightly closed state, as mentioned above. Therefore, there is neither any danger of splashes of the processing solutions nor any contamination caused by the evaporation.

The reciprocation speed of plunger 99 is properly set and the direction of dropping each tablet-shaped processing agent is so set to have the flat surfaces of the tablets to be vertical as shown in FIG. 2. Therefore, water splashes can be reduced to the utmost.

Upon receipt of a signal from light sensitive material area detective sensor 7, control section 11 is started in operation so as to operate tablet-shaped processing agent supplying stepping motors 95 and 97, pinions 96 and 98 driven by the stepping motors, plunger 94 having rack 94A and plunger 99 having rack 99A each linearly driven by the pinions, and replenishing water supply unit 10 and electromagnetic valve 12 at the same time when tablet-shaped processing agent 24 is supplied, so that replenishing water for preparing solutions can be supplied. The amount of replenishing water for preparing solutions may be good enough, provided that tablet-shaped processing agents 24 can be dissolved. This requirement can be satisfied by inputting in advance the operating time of electromagnetic valve 12 and replenishing water supply unit 10 to control section 11.

When the level of processing solution 17 is lowered by the evaporation thereof in the processing tank in the course of controlling the temperature of an automatic processor or stopping the operation, solution level detective sensor 9 detects the lowered solution level and sends a signal to control section 11 so as to operate electromagnetic valve 12 and replenishing water supply unit 10, so that replenishing water for compensating any evaporation can be supplied up to the regular solution level. When reaching the regular level, solution level detective sensor 9 detects the regular level and sends a signal to control section 11, so that electromagnetic valve 12 and replenishing water supply unit 10 can be stopped in operation.

EXAMPLES

The typical examples of the invention will be detailed below. However, the embodiments of the invention shall not be limited thereto.

Example 1

The following bleacher components for color paper use were mixed up well and tableted at a pressure of about 800 kg/cm$^2$ using a tableting machine modified of Model Tough Press Collect 1527HU manufactured by Kikusui Mfg. Works. Thus, eighty (80) pieces of tablet-shaped samples No.1-1 through 1-16 were prepared.

| <Powdered processing agent, bleacher for 1.0 liter use> | |
|---|---|
| Ferric complex salt of an organic acid (See Table 1) | 0.35 mols |
| Potassium bromide or ammonium bromide | 1.50 mols |
| Maleic acid | 30 g |
| Succinic acid | 30 g |
| Disodium ethylenediamine tetraacetate | 1.0 g |

In the resulting bleacher, the ratio of an ammonium cation to the total cations was varied as shown in Table 1 by suitably adjusting the proportions of potassium bromide and ammonium bromide. Every 20 pieces of the bleacher samples was collectively packed in a polyethylene envelope and tightly sealed. Each of them was aged at 50° C. and 70% RH for 3 months. After they were aged, the packaging materials were cut by a cutter. The tablets were added into an agent mixer filled up therein with water and were then dissolved.

Separate from the above, the tablets were dropped naturally from a height of 1 meter and the strength of each of the dropped tablets was observed with the eye and evaluated.

The criteria of the tablet strength evaluation were as follows.

Excellent without any damage;

Only a few damages found in the edge portions (probability: 2%);

Δ A Only a few damages found in the edge portions (probability: 10%); and

X Damages found in the edge portions

The more the mark X, the more the damages were found.

Next, with the processed color paper samples, the magenta reflection densities in the unexposed area and the residual silver amounts in the maximum density areas were each measured. After aging them for 10 days at 40° C. and 70% RH, the contamination produced in the edge portions of the color paper samples were observed with the eye and evaluated. The criteria for evaluating the contamination produced in the edge portions will be given below.

Excellent without any contamination at all;

Δ Only a few contamination found in the edge portions (probability: 1%); and

X Contamination found.

The more the mark X, the more the contamination were found.

The above-mentioned measurements and the results of the evaluation will be given collectively in Table 1.

TABLE 1

| Experiment No. | Ammonium cation ratio in tank bleacher (mol %) | Ferric iron organic acid complex in bleacher | Tablet strength | Magenta reflection density in unexposed area | Residual silver amount (mg/dm$^2$) | Contamination in edges | Ramarks |
|---|---|---|---|---|---|---|---|
| 1-1 | 80 | (L-1)Fe | XX | 0.07 | 0.7 | XX | Comparison |
| 1-2 | 60 | (L-1)Fe | X | 0.06 | 0.5 | X | Comparison |
| 1-3 | 50 | (L-1)Fe | Δ | 0.03 | 0.2 | Δ | Invention |
| 1-4 | 40 | (L-1)Fe | ○-Δ | 0.03 | 0.1 | ○-Δ | Invention |
| 1-5 | 30 | (L-1)Fe | ○-Δ | 0.03 | 0.1 | ○-Δ | Invention |

TABLE 1-continued

| Experiment No. | Ammonium cation ratio in tank bleacher (mol %) | Ferric iron organic acid complex in bleacher | Tablet strength | Magenta reflection density in unexposed area | Residual silver amount (mg/dm$^2$) | Contamination in edges | Ramarks |
|---|---|---|---|---|---|---|---|
| 1-6 | 20 | (L-1)Fe | ○ | 0.02 | 0.1 | ○ | Invention |
| 1-7 | 10 | (L-1)Fe | ◎ | 0.01 | 0 | ○ | Invention |
| 1-8 | 5 | (L-1)Fe | ◎ | 0.01 | 0 | ○ | Invention |
| 1-9 | 0 | (L-1)Fe | ◎ | 0.01 | 0 | ○ | Invention |
| 1-10 | 5 | (L-4)Fe | ◎ | 0.01 | 0 | ○ | Invention |
| 1-11 | 5 | (L-5)Fe | ◎ | 0.01 | 0 | ○ | Invention |
| 1-12 | 5 | (L-9)Fe | ◎ | 0.01 | 0 | ○ | Invention |
| 1-13 | 5 | EDTA.Fe | ○-Δ | 0.02 | 0.4 | ○-Δ | Invention |
| 1-14 | 5 | NTA.Fe | ○ | 0.01 | 0.3 | ○-Δ | Invention |
| 1-15 | 5 | CyDTA.Fe | ○ | 0.02 | 0.2 | ○-Δ | Invention |
| 1-16 | 5 | EDTMP.Fe | ○ | 0.02 | 0.2 | ○-Δ | Invention |

The ferric iron complexes of organic acids will be detailed below.

EDTA·Fe Ferric sodium ethylenediamine tetraacetate

NTA·Fe Ferric sodium nitrilotriacetate

CyDTA·Fe Ferric sodium 1,2-cyclohexanediamine tetraacetate

EDTP·Fe Ferric sodium ethylenediamine tetramethylene phosphonate (L-1)Fe Ferric sodium salt of (L-1)

(L-4) Fe Ferric sodium salt of (L-4)

(L-5)Fe Ferric sodium salt of (L-5)

(L-9)Fe Ferric sodium salt of (L-9)

It can be proved from Table 1 that the ratio of the ammonium cation is excellent when the ratio thereof is not higher than 50 mol % and more excellent results can be displayed when it is not higher than 20 mol %.

It can also be proved that the effects of the invention can be excellent by far when making use of the ferric complexes of the organic acids represented by the foregoing Formula [L] as a bleacher.

As for the color paper, Konica QA Color Paper Type A-5 (manufactured by Konica Corp.) was used.

The color paper samples were each exposed to light through a wedge in the ordinary procedures and were then subjected to a running process in the following processing steps.

| Processing step | Temperature (°C.) | Processing time (sec) | Replenisher (cc/m$^2$) |
|---|---|---|---|
| Color developing | 38 | 20 | 70 |
| Bleaching | 38 | 20 | 50 |
| Fixing | 38 | 20 | 40 |
| Stabilizing | 30 | 20 (In tank 1) | — |
| | | 30 (In tank 2) | 120 |
| Drying | 60~80 | 30 | |

Tanks 1 and 2 for the stabilizing step were constituted as a counter-current system and the replenisher was supplied to tank 2.

The following processing solutions used in the processing steps were as follows.

| Color developer | |
|---|---|
| Pure water | 800 cc |
| Potassium bromide | 0.02 g |
| Potassium chloride | 3.3 g |
| Potassium carbonate | 25 g |
| Potassium sulfite | 0.2 g |
| Sodium diethylenetriamine pentaacetate | 3.0 g |
| 1-(N-ethyl-N-methanesulfoneamidoethyl)-3- | 4.5 g |

-continued

| Color developer | |
|---|---|
| methyl-p-phenylenediamine.3/2$H_2SO_4$.$H_2O$ (CD-3) | |
| Sodium hydrogencarbonate | 3.1 g |
| HO—N($CH_2CH_2SO_3Na$)$_2$ | 6.5 g |
| Cinopar SFP (manufactured by Ciba-Geigy AG) | 2.5 g |
| Add water to make in total of | 1 liter |
| Adjust pH to be | pH = 10.00 |

Bleacher

A processing solution prepared by dissolving the foregoing tablet-shaped bleacher in water was used upon storing at 38° C. for 7 days in a 1 l vessel. The bath opening ratio was 20 cm$^{-1}$.

| | |
|---|---|
| Fixer | |
| Sodium thiosulfate | 100 g |
| Sodium thiocyanate | 100 g |
| Sodium bisulfite, anhydrous | 20 g |
| Sodium metabisulfite | 4.0 g |
| Disodium ethylenediamine tetraacetate | 1.0 g |
| Add water to make in total of | 1 liter |
| Adjust pH with glacial acetic acid and aqueous ammonia to be | pH = 6.5 |
| Stabilizer | |
| Water | 800 cc |
| 1,2-benzoisothiazoline-3-one | 0.1 g |
| 1-hydroxyethylidene-1,1-diphosphonic acid | 5.0 g |
| Ethylenediamine tetraacetic acid | 1.0 g |
| Cinopar SFP (manufactured by Ciba-Geigy AG) | 2.0 g |
| Ammonium sulfate | 2.5 g |
| Zinc chloride | 1.0 g |
| Magnesium chloride | 0.5 g |
| o-phenylphenol | 1.0 g |
| Sodium sulfite | 2.0 g |
| Add water to make | 1 liter |
| Adjust pH with a 50% sulfuric acid solution or a 25% aqueous ammonia solution to be | pH = 8.0 |

Example 2

Eighty (80) pieces each of samples No. 2-1 through 2-16 were prepared in the ordinary procedures described in this specification by well mixing up the components of the following color negative bleacher so as to prepare a powdered processing agent for 1 liter use and by making use of a tableting machine.

| | |
|---|---|
| Ferric complex of an organic acid (see Table 2) | 0.50 mols |
| Sodium ethylenediamine tetraacetic acid | 5 g |
| Potassium bromide or ammonium bromide | 1.5 mols |
| Sodium nitrate or ammonium nitrate | 0.42 mols |
| Maleic acid | 28 g |

The ratio of an ammonium cation content to the total cation content in the bleacher was varied as shown in Table 2 by suitably adjusting the ratios of potassium bromide to ammonium bromide and sodium nitrate to ammonium nitrate, respectively. The strength of each tablet was tested in the procedures and conditions described in Example 1.

Next, a color negative film sample, Super DD100 (manufactured by Konica Corp.), was exposed to light through a wedge in the ordinary procedures and was then processed in the following processing steps.

| Processing step | Processing temperature | Processing time |
|---|---|---|
| Color developing | 38 ± 0.3° C. | 3 min 15 sec |
| Bleaching | 38 ± 2.0° C. | 45 sec |
| Fixing | 38 ± 2.0° C. | 1 min 30 sec |
| Stabilizing | 38 ± 5.0° C. | 30 sec (in tank 1) 30 sec (in tank 2) |
| Drying | 60 ± 5.0° C. | 1 min. |

Tanks 1 and 2 of the stabilizing tank were constituted as a counter-current system and the replenisher was replenished to tank 2. The processing solutions used in the above-mentioned processing steps were as follows.

| Color developer (for 1 liter use) | |
|---|---|
| Potassium carbonate | 30 g |
| Sodium hydrogencarbonate | 3.5 g |
| Sodium 1-hydroxyethane-1,1-diphosphonate | 2.5 g |
| Sodium diethylenetriamine pentaacetate | 2.0 g |
| 4-amino-3-methyl-N-(β-hydroxylethyl)-aniline sulfate, (CD-4) | 4.8 g |
| Sodium sulfite | 3.5 g |
| (H)—N($CH_2CH_2SO_3Na$)$_2$ | 2.8 g |
| Sodium bromide | 1.3 g |
| Potassium iodide | 0.8 mg |

Bleacher (for 1 liter use)

A processing solution prepared by dissolving the foregoing tablet-shaped bleacher in water was used after storing at 38° C. for 7 days in a 1 l vessel. The bath opening ratio was 20 $cm^{-1}$.

| Fixer (for 1 liter use) | |
|---|---|
| Sodium thiosulfate | 200 g |
| Sodium sulfite | 20 g |
| Potassium thiocyanate | 100 g |
| Sodium ethylenediamine tetraacetate | 5 g |
| Sodium paratoluene sulfinate | 4 g |
| Stabilizer (for 1 liter use) | |
| m-hydroxybenzaldehyde | 2 g |
| Polyethylene glycol (having a molecular weight of 1540) | 2 g |
| A 10-mol ethylene oxide adduct of p-octylphenol | 2 g |
| Diethylene glycol | 5 g |

With the processed color negative film sample, the blue transmission density in the unexposed areas and the residual silver concentration in the maximum density area were measured. The results thereof are shown in Table 2.

TABLE 2

| Experiment No. | Ammonium cation ratio in tank bleacher (mol %) | Ferric iron organic acid complex in bleacher | Tablet strength | Blue transmission density in unexposed area | Residual silver amount (mg/dm$^2$) | Remarks |
|---|---|---|---|---|---|---|
| 2-1 | 80 | (L-1)Fe | XX | 0.62 | 0.7 | Comparison |
| 2-2 | 60 | (L-1)Fe | X | 0.58 | 0.5 | Comparison |
| 2-3 | 50 | (L-1)Fe | Δ | 0.52 | 0.2 | Invention |
| 2-4 | 40 | (L-1)Fe | ○-Δ | 0.51 | 0.1 | Invention |
| 2-5 | 30 | (L-1)Fe | ○-Δ | 0.51 | 0.1 | Invention |
| 2-6 | 20 | (L-1)Fe | ○ | 0.50 | 0.1 | Invention |
| 2-7 | 10 | (L-1)Fe | ◎ | 0.50 | 0 | Invention |
| 2-8 | 5 | (L-1)Fe | ◎ | 0.50 | 0 | Invention |
| 2-9 | 0 | (L-1)Fe | ◎ | 0.50 | 0 | Invention |
| 2-10 | 5 | (L-4)Fe | ◎ | 0.51 | 0 | Invention |
| 2-11 | 5 | (L-5)Fe | ◎ | 0.50 | 0 | Invention |
| 2-12 | 5 | (L-9)Fe | ◎ | 0.51 | 0 | Invention |
| 2-13 | 5 | EDTA.Fe | ○-Δ | 0.53 | 0.4 | Invention |
| 2-14 | 5 | NTA.Fe | ○ | 0.52 | 0.3 | Invention |
| 2-15 | 5 | CyDTA.Fe | ○ | 0.53 | 0.2 | Invention |
| 2-16 | 5 | EDTMD.Fe | ○ | 0.53 | 0.2 | Invention |

In the table, the ferric complexes of organic acids were the same as those given in Table 1.

It is proved from Table 2 that the results were excellent when the ammonium cation content was not higher than 50 mol % and more excellent when the content was not higher than 20 mol %. In particular, it is also proved that the results were remarkably excellent when containing a compound (L) of the invention and having an ammonium cation containing ratio of not higher than 10 mol %.

Example 3

The granulated products were prepared by treating the color paper bleachers for Experiment Nos. (1-3), (1-6) and (1-8) tried in Example 1 and they were tableted, so that the tablets were produced. (See Experiment Nos. 3-1 through 3-3)

Treatment 1

The ferric complex salt of an organic acid (see Table 3) of 0.35 mols, succinic acid of 30 g, maleic acid of 30 g, disodium ethylenediamine tetraacetate of 1 g and potassium bromide or sodium bromide were each mixed up uniformly by taking a time for 10 minutes, by making use of a mixer.

Next, the mixture was pulverized in an air-jet pulverizing mill until they had an average particle size of about 10 μm.

The resulting fine powder were granulated in a currently marketed fluid-bed spray granulator by spraying 4.5 cc of water for about 5 minutes and the resulting granules were then dried at 60° C. for 10 minutes. Next, they were dried in a vacuum at 40° C. for 2 hours, so that the moisture content of the granules was removed until the moisture was reduced to be not more than 2%. From the resulting granules, the fine granules smaller than 100 μm and those larger than 800 μm were each separately filtrated by making use of a currently marketed shaker. (The yield thereof was 90%.)

Treatment 2

The resulting granules were filled, in an amount filled of 6.0 g per tablet, in a mortar having a diameter of 30 mm and they were tableted at a compression of 800 Kg/cm$^2$ by a tableting machine, a modified model of Tough Press Collect 1527HU manufactured by Kikusui Mfg. Work, so that 80 pieces of bleacher could be prepared.

After the resulting bleacher samples were stored in the same way as in Example 1, they were added to a agent mixer and then dissolved, respectively. Among the every sample, those prepared by granulating and then tableting them could have each the dissolving time 10 to 20% shorter than the others.

Next, by making use of the color paper samples prepared in Example 1, the running processes were tested in the same way as in Example 1.

The results of the evaluation tried in the same way as in Example 1 will be given collectively in Table 3.

Therein, the same color developer, fixer and stabilizer as in Example 1 were used.

TABLE 3

| Experiment No. | Ammonium cation ratio in tank bleacher (mol %) | Ferric iron organic acid complex in bleacher | Tablet strength | Blue reflection density in unexposed area | Residual silver amount (mg/dm$^2$) | Contamination in edges |
|---|---|---|---|---|---|---|
| 3-1 | 50 | (L-1)Fe | ○ | 0.02 | 0.1 | ○-Δ |
| 3-2 | 20 | (L-1)Fe | ◎ | 0.01 | 0.1 | ○ |
| 3-3 | 5 | (L-1)Fe | ◎ | 0.01 | 0 | ○ |

It is proved from the contents of Table 3 that the tablet prepared by tableting them after they were granulated are capable of not only improving the solubility, but also displaying the effects of the invention excellently by far.

Example 4

The tablet samples prepared in Example 3 and the color paper samples used in Example 1 were each used to carry out the rest in the same manner as in Example 1, except that the automatic processors equipped with the tablet-shaped processing agent supply units shown in FIGS. 1 and 2 was used.

The results of the evaluation carried out in the same way as in Example 1 will be given in Table 4.

TABLE 4

| Experiment No. | Ammonium cation ratio in tank bleacher (mol %) | Ferric iron organic acid complex in bleacher | Tablet strength | Blue reflection density in unexposed area | Residual silver amount (mg/dm$^2$) | Contamination in edges |
|---|---|---|---|---|---|---|
| 4-1 | 50 | (L-1)Fe | ○ | 0.01 | 0 | ○ |
| 4-2 | 20 | (L-1)Fe | ◎ | 0.01 | 0 | ○ |
| 4-3 | 5 | (L-1)Fe | ◎ | 0.01 | 0 | ○ |

It is proved from Table 4 that, when making use of the automatic processor equipped with a tablet-shaped processing agent supply unit, the effects of improving the desilvering property and preventing any magenta stain and the contamination produced in the edge portions can much more be displayed.

Example 5

The tablets having bulk density shown in Table 5 were prepared by changing the compression applied in (Treatment 2) of Experiment No. 3-3 shown in Table 3 given in Example 3.

The strength of the tablets were evaluated in the same manner as in Example 1 and the results thereof are shown in Table 5.

The behavior of dissolving the tablets was observed and the results thereof are shown in the column of the remarks.

TABLE 5

| Experiment No. | Bulk density (g/cm$^2$) | Tablet strength | Remarks |
|---|---|---|---|
| 5-1 | 0.50 | Δ | Rapidly dissolved |
| 5-2 | 0.90 | Δ | Rapidly dissolved |
| 5-3 | 1.00 | ○-Δ | Rapidly dissolved |
| 5-4 | 1.10 | ○ | Rapidly dissolved |
| 5-5 | 1.50 | ◎ | Rapidly dissolved |
| 5-6 | 2.00 | ◎ | Rapidly dissolved |
| 5-7 | 2.50 | ◎ | Rapidly dissolved |
| 5-8 | 2.60 | ◎ | Dissolved in 10% longer time |
| 5-9 | 3.00 | ◎ | Dissolved in 15% longer time |
| 5-10 | 3.10 | ◎ | Dissolved in 25% longer time |

It is proved from Table 5 that the bulk density of the tablets is to be within the range of 1.00 to 3.00 g/cm$^2$ and preferably, 1.10 to 2.50 g/cm$^2$, from the viewpoints of the strength and solubility of the tablets.

What is claimed is:

1. A tablet-shaped bleaching agent for providing a photographic bleaching solution for a silver halide color photographic light-sensitive material; said bleaching agent having a bulk density of 1.00 to 3.00 g/cm$^3$ and comprising a ferric complex salt of a compound represented by the following Formula (L);

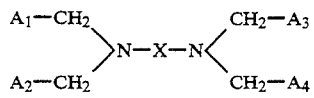

Formula (L)

wherein $A_1$, $A_2$, $A_3$ and $A_4$ each represent —$CH_2OH$, —COOM or —$PO_3M_1M_2$ wherein M, $M_1$ and $M_2$ each represent a hydrogen atom, an alkali metal atom or an ammonium group, provided that $A_1$, $A_2$, $A_3$ and $A_4$ may be the same as or different from each other; and X represents a substituted or unsubstituted alkylene group having 3 to 6 carbon atoms, an ammonium cation content not higher than 50 mol % based on the total cation content, and a compound represented by the following Formula (C);

Formula (C)

$$A_5—(COOM)_n$$

wherein $A_5$ is an organic group; M is a hydrogen atom, an alkali metal atom or an ammonium group, provided that a plurality of M's may be the same as or different from each other; and n is an integer of not less than 2.

2. The agent of claim 1, wherein the ammonium cation content is not higher than 20 mol % based on the total cation content.

3. The agent of claim 1, having a bulk density of 1.10 to 2.50 g/cm$^3$.

4. The agent of claim 1, manufactured by a method comprising the steps of granulating powder comprising a compound represented by the following Formula (C) and a ferric complex salt of a compound represented by the following Formula (L);

Formula (C)

$$A_5—(COOM)_n$$

wherein $A_5$ is an organic group; M is a hydrogen atom, an alkali metal atom or an ammonium group, provided that a plurality of M's may be the same as or different from each other; and n is an integer of not less than 2,

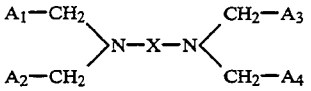

Formula (L)

wherein $A_1$, $A_2$, $A_3$, and $A_4$ each represents —$CH_2OH$, —COOM or —$PO_3M_1M_2$ wherein M, $M_1$ and $M_2$ each represent a hydrogen atom, an alkali metal atom or an ammonium group, provided that $A_1$, $A_2$, $A_3$ and $A_4$ may be the same as or different from each other; and X represents a substituted or unsubstituted alkylene group having 3 to 6 carbon atoms, and then forming the granulated material into tablets.

5. The agent of claim 1, wherein n of said Formula (C) is an integer of 2 or 3.

6. The agent of claim 5, wherein the compound represented by Formula (C) is selected from the group consisting of the following compounds (C-1) to (C-16):

(C-1) $HOOCCH_2C(OH)(COOH)CH_2COOH$
(C-2) $HOOC(CHOH)_2COOH$
(C-3) $HOOCCH_2COOH$
(C-4) $HOOCCH(OH)CH_2COOH$
(C-5) HOOCCH=CHCOOH
(C-6) $HOOCCH_2CH_2COOH$
(C-7) $(COOH)_2$ (C-8)

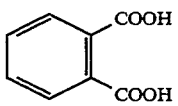

(C-9)

-continued

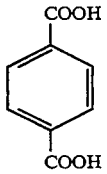

(C-10) NaOOCCH=CHCOONa
(C-11) KOOCCH=CHCOOK
(C-12) $H_4NOOCCH=CHCOONH_4$ (C-13)

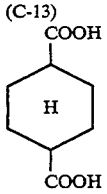

(C-14)

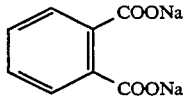

(C-15)

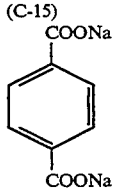

(C-16)
$HOOC\text{-}(CH_2)_5\text{-}COOH$.

7. A method for preparing a photographic bleaching solution for a silver halide color photographic light-sensitive material, said method comprising the steps of dissolving a tablet-shaped processing agent in water, wherein the agent has a bulk density of 1.00 to 3.00 g/cm$^2$ and comprises a ferric complex salt of a compound represented by the following Formula (L);

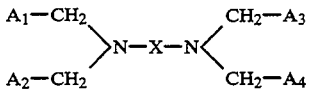

Formula (L)

wherein $A_1$, $A_2$, $A_3$ and $A_4$ each represents —$CH_2OH$, —COOM or —$PO_3M_1M_2$ wherein M, $M_1$ and $M_2$ each represent a hydrogen atom, an alkali metal atom or an ammonium group, provided that $A_1$, $A_2$, $A_3$ and $A_4$ may be the same as or different from each other; and X represents a substituted or unsubstituted alkylene group having 3 to 6 carbon atoms and an ammonium cation content of not higher than 50 mol % based on the total cation content.

8. A method for processing a color silver halide photographic light-sensitive material comprising:

exposing the light-sensitive material;

developing the exposed material;

processing the developed material with a photographic processing solution; and replenishing the photographic processing solution by adding a tablet-shaped photographic processing agent to the photographic processing solution depending upon the surface area of the material to be processed, the tablet-shaped agent having a bulk density of 1.00 to 3.00 g/cm$^2$ and comprising a ferric complex salt of a compound represented by the following Formula (L);

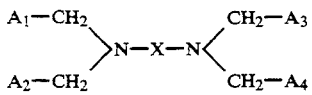

Formula (L)

wherein $A_1$, $A_2$, $A_3$ and $A_4$ each represents —$CH_2OH$, —COOM or —$PO_3M_1M_2$ wherein M, $M_1$ and $M_2$ each represent a hydrogen atom, an alkali metal atom or an ammonium group, provided that $A_1$, $A_2$, $A_3$ and $A_4$ may be the same as or different from each other; and X represents a substituted or unsubstituted alkylene group having 3 to 6 carbon atoms, an ammonium cation content not higher than 50 mol % based on the total cation content; and a compound represented by the following Formula (C);

Formula (C)

wherein $A_5$ is an organic group; M is a hydrogen atom, an alkali metal atom or an ammonium group, provided that a plurality of M's may be the same as or different from each other; and n is an integer of not less than 2.

* * * * *